US005787510A

United States Patent [19]

Jackson, Jr.

[11] Patent Number: 5,787,510

[45] Date of Patent: Aug. 4, 1998

[54] HIGH STRETCH COMPOSITE ELASTIC WAISTBAND

[76] Inventor: Clyde E. Jackson, Jr., 28 Perthshire Dr., Peachtree City, Ga. 30269

[21] Appl. No.: 840,748

[22] Filed: Apr. 16, 1997

Related U.S. Application Data

[60] Provisional application No. 60/015,834 Apr. 19, 1996.

[51] Int. Cl. [6] ..... A41D 1/06

[52] U.S. Cl. ..... 2/243.1; 2/221; 2/237; 2/76; 139/422; 66/172 E

[58] Field of Search ..... 2/76, 220, 221, 2/236, 237, 338, 67, 401, 243.1, 240, 311, 312; 66/169 R, 170, 172 E, 202; 87/2; 24/712; 139/421, 422; 112/413–419

[56] References Cited

U.S. PATENT DOCUMENTS

| | | |
|---|---|---|
| Re. 33,586 | 5/1991 | Graff . |
| 162,353 | 4/1875 | Culp . |
| 240,645 | 4/1881 | Bernstein . |
| 735,560 | 8/1903 | Muller . |
| 1,475,653 | 11/1923 | Rosenberg . |
| 1,686,630 | 10/1928 | Loveman . |
| 1,921,271 | 8/1933 | Lubin . |
| 1,941,509 | 1/1934 | Allen . |
| 2,084,938 | 7/1937 | Busch et al. . |
| 2,088,302 | 7/1937 | McKeever . |
| 2,197,188 | 4/1940 | Lilley . |
| 2,392,221 | 1/1946 | Brady . |
| 2,418,582 | 4/1947 | Stumpf . |
| 2,551,044 | 5/1951 | Ottinger et al. . |
| 2,721,331 | 10/1955 | Scheitlin . |
| 2,854,670 | 10/1958 | Naccash . |
| 2,936,603 | 5/1960 | Lewine . |
| 2,998,829 | 9/1961 | Horowitz . |
| 3,167,941 | 2/1965 | Rab . |
| 3,172,430 | 3/1965 | Weidhaas . |
| 3,236,070 | 2/1966 | Clayton, Jr. . |
| 3,887,968 | 6/1975 | Lynam . |
| 4,714,096 | 12/1987 | Guay ..... 139/421 |
| 5,040,244 | 8/1991 | Tubbs . |
| 5,186,779 | 2/1993 | Tubbs . |
| 5,375,266 | 12/1994 | Crisco . |
| 5,452,591 | 9/1995 | King . |

FOREIGN PATENT DOCUMENTS

| | | |
|---|---|---|
| 832556 | 9/1938 | France . |
| 1474814 | 2/1967 | France . |
| 1208680 | 1/1966 | Germany . |
| 3510790 | 9/1986 | Germany ..... 139/422 |
| 17330 | 8/1898 | Switzerland . |
| 1306 | 11/1914 | United Kingdom . |
| 632522 | 11/1949 | United Kingdom . |
| 1392199 | 4/1975 | United Kingdom . |

OTHER PUBLICATIONS

A page from a medical publication disclosing, and a sample of, an abdominal binder (i.e., bandage) that was on sale in the U.S. before Apr. 1995.

*Primary Examiner*—Gloria M. Hale
*Attorney, Agent, or Firm*—Jones & Askew, LLP

[57] ABSTRACT

Provided is a high stretch composite elastic waistband that includes a relatively large ratio of drawcord to the relaxed length of the elastic web. The drawcord is fixed to the elastic web in such a way that the drawcord is allowed to oscillate to form multiple drawcord protrusions, such as protruding loops or partial loops, as the elastic web returns to its relaxed size. The drawcord protrusions extend relative to the elastic web. The composite elastic waistband is constructed so that at least a section of the drawcord is capable of being pulled away from the elastic web so that the protrusions are at least partially flattened. Then the elastic web is capable of being stretched and released so that the elastic web contracts and cooperates with the drawcord to form the plurality of drawcord protrusions. This accumulates excess portions of the drawcord. The drawcord is movably attached to the elastic band by connecting stitches so that the drawcord extends in the longitudinal direction. Spaces are defined between neighboring connecting stitches so that a plurality of spaces are defined. The protrusions defined by the drawcord extend through the spaces defined between the stitches.

20 Claims, 4 Drawing Sheets

HIGH STRETCH COMPOSITE ELASTIC WAISTBAND

RELATED APPLICATION

This application claims the benefit of U.S. Provisional application Ser. No. 60/015,834, filed Apr. 19, 1996.

BACKGROUND OF THE INVENTION

Elastic waistbands and drawcords are frequently used in athletic apparel such as gym shorts, sweat pants, and swim trunks. The elastic waistband provides a fairly snug fit for wearers of different sizes. The drawcord may be pulled snug and tied into a bow in order to obtain a tighter and more secure fit than is provided by the elastic waistband alone. In order to have enough drawcord to tie a satisfactory bow, the drawcord must be at least several inches longer than the circumference of the elastic waistband when the waistband is stretched to fit around the wearer's waist. Obviously, this requires the length of the drawcord to be considerably greater than the length of the elastic waistband when the waistband is in a relaxed, or unstretched, condition.

In many garments of this type, the elastic waistband and drawcord are incorporated into the garment in separate steps. The waistband is first sewn into a loop, which is then stretched and placed on a machine that holds the garment. The stretched waistband is then sewn to the garment using sewn seams that run around the circumference of the opening. A channel is then formed between two of the seams, and the drawcord is inserted into the channel by inserting a flexible wire with a hook into the channel and pulling the drawcord through the channel. This method allows the manufacturer to include a drawcord having any desired length. However, this method is labor intensive and significantly increases production costs.

Several prior art products attempt to simplify the manufacturing process by providing composite waistbands in which the drawcord is combined with the elastic band before the elastic band is sewn into the garment. In many manufacturing plants, the composite waistband is sewn into a loop that is stretched and placed on a machine that holds the garment. After the garment and the composite waistband are sewn together, the garment is removed from the machine. This allows the elastic to contract and return to an unstretched state, which causes the waist of the garment to bunch up.

One type of composite waistband is described in U.S. Pat. No. Re. 33,586, entitled "Elastic with Embedded Pull Cord." This patent describes a woven, knitted or braided elastic band in which a pull cord is "embedded." This composite waistband is sewn in a garment as described above. A portion of the drawcord is then pulled through the elastic band and through a slit in the waist of the garment, where the ends of the drawcord are available to be tied into a bow.

Another type of composite waistband is described in U.S. Pat. Nos. 5,375,266, entitled "Composite Drawcord/Elastic Waistband" and 5,452,591, entitled "Knitted Band with Integrated Drawcord and Method of Fabricating Same." Those patents disclose a drawcord that is secured to one side of an elastic band by a yarn that lays over the drawcord to define a tunnel that holds the drawcord to the surface of the elastic band.

Each of the above-discussed prior art composite waistbands simplifies the process of sewing an elastic waistband and drawcord in a garment. However, the amount of drawcord that can be incorporated into those prior art composite waistbands and the degree to which those prior art composite waistbands can be stretched are limited. The above-discussed prior art composite waistbands are typically cut from a "continuous" elongate strip of composite waistband. The elongate strip of composite waistband is constructed so that when the elongate strip is in a stretched or unstretched state, all of the drawcord is maintained generally parallel to the elastic web of the composite waistband. That is, there is no place for substantial amounts of excess drawcord to reside when the composite waistband is in a relaxed or unstretched configuration. This severely limits the length of the drawcord. When the length of the drawcord is limited, the degree to which the composite waistband can be stretched is limited. If the elastic web of a composite waistband is stretched to a length longer than the drawcord, the ends of the drawcord are lost in the elastic web and the composite waistband cannot be used properly. Also, there is no value in increasing the stretchability of the elastic web of a composite waistband when the degree to which the composite waistband can be stretched is limited by the length of the drawcord.

Because the drawcord remains generally parallel to the elastic band in the above-discussed prior art composite waistbands, the length of the drawcord is generally limited to that which can be compressed coaxially (i.e., along the cord's longitudinal axis) to the same length as the elastic band in a relaxed state. Therefore, in most prior art composite waistbands, drawcords that can be readily coaxially compressed are employed in an effort to increase the effective length of the drawcords. However, at least some of such cords can shrink and lose their stretchability when laundered. Further, it is sometimes desirable to use a flat, tape-like drawcord (e.g., ribbon) in a composite waistband, and the axial compressibility of most flat drawcords is very limited.

Another type of composite waistband is described in U.S. Pat. Nos. 5,040,244, entitled "Elastic Waistband with Releasably Secured Drawstring" and 5,186,779, entitled "Method of Making an Elastic Waistband with Releasably Secured Drawstring." These patents describe a drawcord that is affixed to a previously fabricated elastic band by an adhesive The adhesive holds the drawcord in place on one surface of the elastic band while the band is sewn in a garment. After the garment is sewn, the drawcord is released from the elastic band by pulling on the drawcord. A problem with this approach is that careful handling is required in order to prevent the drawcord from being detached from the elastic band prior to being sewn in the garment. If the drawcord becomes detached prematurely, the product is useless. Also, having to release numerous drawcords from their respective elastic bands is labor intensive.

Another type of composite waistband is described in U.S. Pat. No. 3,887,968, entitled "Composite Elastic Band for use with a Garment." This patent discloses a composite band comprising two co-planar elastic strips, a drawcord, and two covering strips. The elastic strips include parallel longitudinally extending edges that define a channel therebetween. The channel is occupied by the longitudinally extending drawcord, which is free to move in the channel. The elastic strips and drawcord are sandwiched between the longitudinally extending covering strips. The covering strips are attached to the elastic strips by stitching. The drawcord puckers within the channel when the composite band is unstretched. This provides a surplus length of the drawcord so that the ends of the drawcord can be drawn out of the channel. Because the drawcord is maintained within the channel, the aforementioned puckering of the drawcord occurs within the channel. Thus, the size of the channel can limit the amount of puckering and therefore the amount of drawcord, which can limit the degree to which the composite waistband can be stretched. Efforts to increase the size of the channel may result is a composite waistband that is undesirably bulky, or may reduce the tendency of the drawcord to pucker.

Therefore, there is a need in the art for a high stretch composite waistband that includes a relatively large ratio of drawcord to the relaxed length of the elastic band.

SUMMARY OF THE INVENTION

The present invention provides a high stretch composite elastic waistband that includes a relatively large ratio of drawcord to the relaxed length of an elastic web of the waistband. The present invention accomplishes this by affixing the drawcord to the elastic web in such a way that the drawcord is allowed to oscillate to form multiple drawcord protrusions, such as protruding loops or partial loops, as the elastic web returns to its relaxed size.

The drawcord protrusions extend relative to the elastic web. The composite elastic waistband is constructed so that at least a section of the drawcord is capable of being pulled away from the elastic web so that the protrusions are at least partially flattened. Then the elastic web is capable of being stretched and released so that the elastic web contracts and cooperates with the drawcord to again form the plurality of drawcord protrusions.

In accordance with exemplary embodiments of the present invention, the drawcord is movably attached to the elastic web by multiple connector members, such as connecting stitches or the like, so that the drawcord extends in the longitudinal direction. Spaces are defined between neighboring connecting stitches. Individual protrusions defined by the drawcord extend through individual spaces defined between the stitches.

Even more particularly, the composite elastic waistband includes a pair of elastic webs, each of which includes a longitudinally extending edge. A longitudinally extending space is defined between the finished edges. The connecting stitches extend laterally across the longitudinally extending space and join the edges to define a composite elastic band. The drawcord is laced through the connecting stitches, or through a plurality of openings defined at least partially by the connecting stitches, so that the drawcord protrusions protrude from the longitudinally extending space and between the stitches.

In accordance with the exemplary embodiments of the present invention, the composite elastic waistband is manufactured by forming a longitudinally extending elastic web that is elastic in the longitudinal direction. The elastic web is formed under longitudinal tension. Contemporaneous with the forming of the elastic web, a longitudinally extending drawcord is connected to the elastic web. After the drawcord is connected to the elastic web, the elastic web is released from tension so that the elastic web contracts and causes the drawcord to define the drawcord protrusions.

After the composite elastic waistband is manufactured, the drawcord can be pulled away from the elastic web so that the drawcord protrusions are at least partially flattened. Then, the elastic web can be stretched and released so that the elastic web contracts and causes the drawcord to define the drawcord protrusions. The composite waistband can be cut into lengths, formed into loops, and then incorporated into garments, as should be understood by those skilled in the art.

In accordance with a first exemplary embodiment of the present invention, a cross-section of the drawcord taken perpendicular to its length is somewhat circular. In accordance with a second exemplary embodiment of the present invention, the drawcord is flat so that a cross-section of the drawcord taken perpendicular to its length is generally linear.

It is an object of the present invention to provide a high stretch composite elastic waistband with a high ratio of drawcord to elastic web.

It is another object of the present invention to provide a high stretch composite elastic waistband that contains sufficient drawcord so that the stretchability of the waistband is not restricted by the drawcord.

It is another object of the present invention to provide a high stretch composite elastic waistband that may be easily loaded onto automatic or manual machines that attach composite elastic waistbands to garments.

It is another object of the present invention to provide a high stretch composite elastic waistband that includes an ample amount of drawcord for tying a large bow.

It is another object of the present invention to provide a high stretch composite elastic waistband that is constructed in a manner that allows the stretchability of the elastic web to be maximized and utilized.

These and other objects, features, and advantages of the present invention may be more clearly understood and appreciated from a review of the following detailed description of the disclosed embodiments and by reference to the appended drawings.

DETAILED DESCRIPTION OF EXEMPLARY EMBODIMENTS

The present invention will now be described with reference to the drawings, in which like numerals represent like elements throughout the several views.

Figure 1:
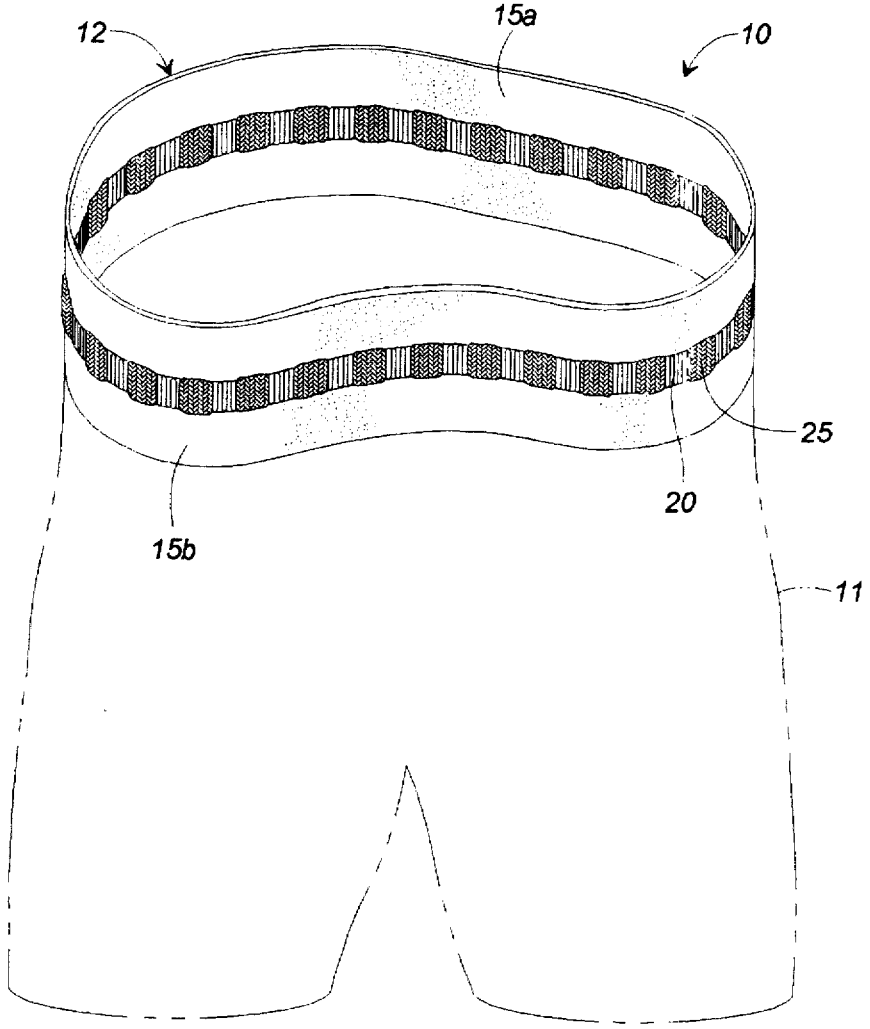
FIG. 1 is a schematic, perspective view of the high stretch composite waistband constructed in accordance with the first exemplary embodiment of the present invention, wherein a garment is shown in broken-lines.
Figure 2:
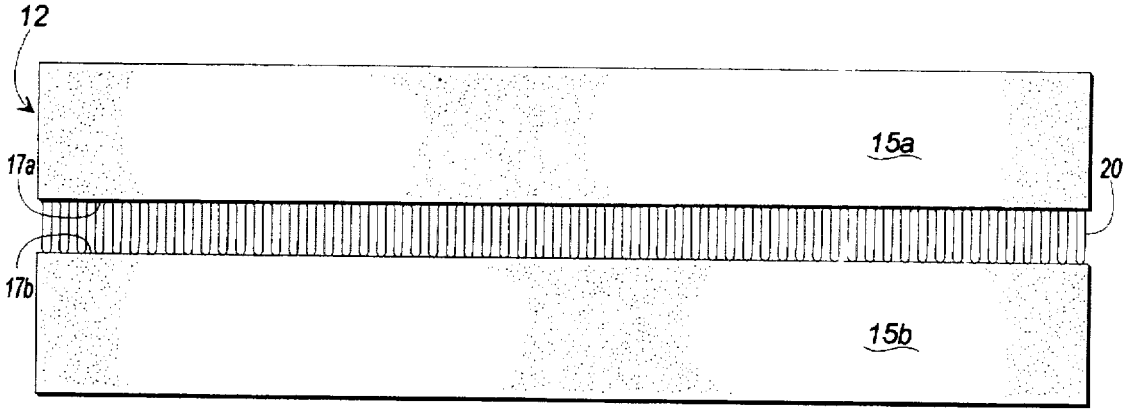
FIG. 2 is a side view of a section of the joined elastic webs that form the composite elastic band of the high stretch composite waistband of FIG. 1.
Figure 5:
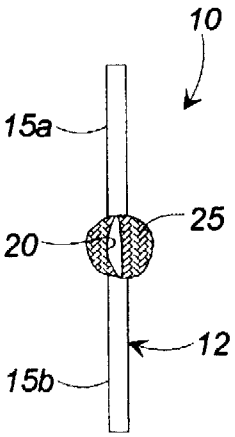
FIG. 5 is a cross-sectional view of the high stretch composite waistband taken along the line 5—5 of FIG. 4.
Figure 3:
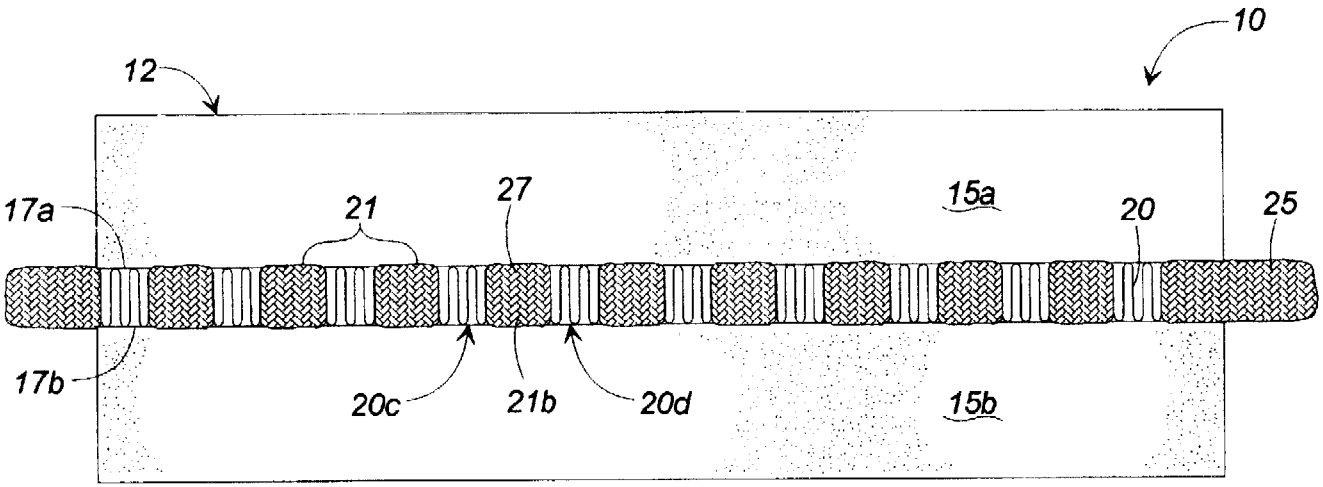
FIG. 3 is a side view of a section of the high stretch composite waistband of FIG. 1, wherein the composite elastic band has accumulated excess portions of the drawcord.
Figure 4:
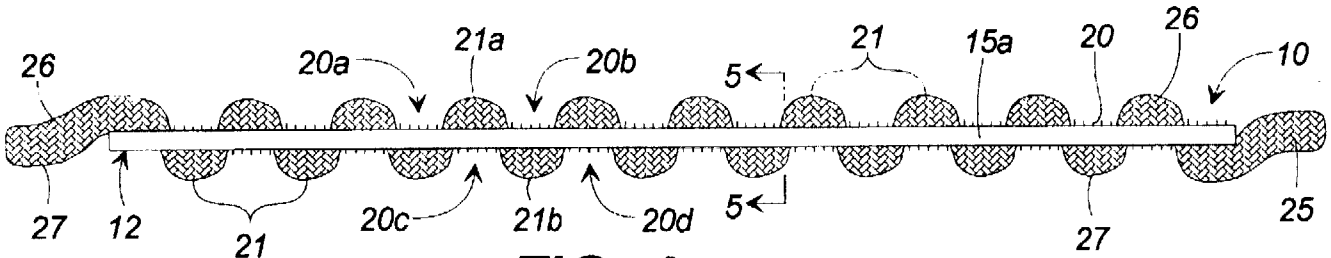
FIG. 4 is a top view of the high stretch composite waistband of FIG. 3.
Figure 7:
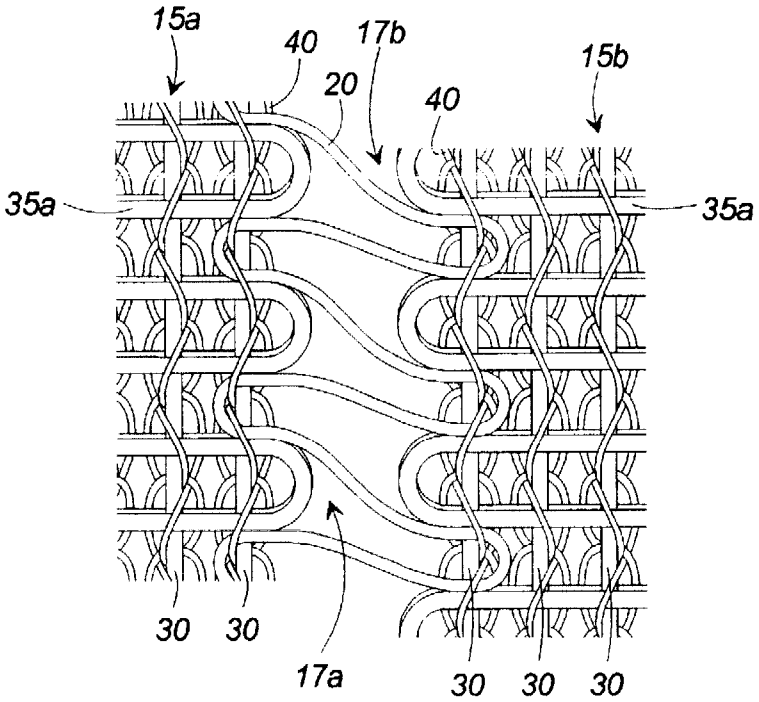
FIG. 7 is a partial, magnified view of two pieces of knitted elastic web joined by a connecting stitch.
Figure 6:
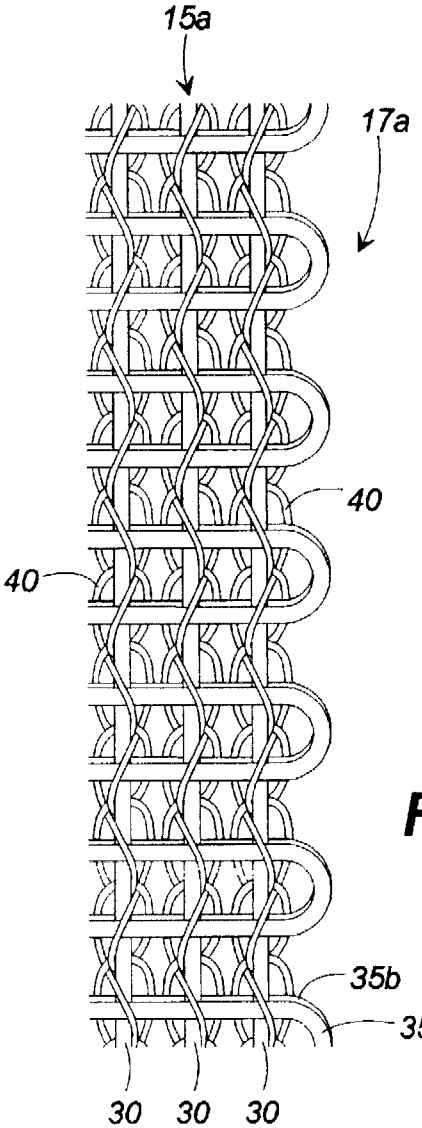
FIG. 6 is a partial, magnified view of a piece of a knitted elastic web.

A high stretch composite waistband 10 constructed in accordance with the first exemplary embodiment of the present invention provides a composite waistband 10 that incorporates a relatively large amount of drawcord 25. FIG. 1 shows the composite waistband 10 after it has been sewn into a loop and attached to an exemplary pair of pants 11, which are depicted by broken lines. The pair of pants 11 are constructed from a piece of cloth that has a perimeter, which defines an opening, to which the composite waistband 10 is attached. FIGS. 3–5 illustrate a section of the composite waistband 10 in a generally planar configuration. FIGS. 2, 6, and 7 illustrate portions of the composite waistband 10 in generally planar configurations, without showing the drawcord 25.

The first exemplary high stretch composite waistband 10 includes two elastic webs 15*a*, 15*b* that are held together by a connecting stitch 20. The connecting stitch 20 includes multiple individual stitches that join the elastic webs 15*a*, 15*b* to define a composite elastic band 12. Throughout the several views of this disclosure, the elastic webs 15*a*, 15*b*, and therefore the composite elastic band 12, are relaxed (i.e., unstretched). The drawcord 25 is laced, at predetermined intervals, back and forth through openings or spaces defined between neighboring stitches of the connecting stitch 20. The oscillation and penetration of the drawcord 25 through openings defined by the connecting stitch 20 allows a large amount of drawcord 25 to be connected to the relaxed elastic webs 15*a*, 15*b*. As discussed in greater detail below, the drawcord 25 is preferably not drawn through a premanufactured connecting stitch 20. Rather, during manufacture the connecting stitch 20 is preferably alternately stitched on opposite sides of the drawcord 25 to provide the interlaced relationship between the drawcord 25 and the connecting stitch 20.

The high ratio of drawcord 25 to composite elastic band 12 is provided in the present invention by allowing the drawcord 25 to oscillate or form multiple drawcord protrusions 21, such as protruding loops or partial loops, between groups of connecting stitches 20. The drawcord protrusions 21 extend outward relative to the composite elastic band 12. This protruding or looping is illustrated in FIG. 4, where the composite elastic band 12 is relaxed and has accumulated or gathered excess portions of the drawcord 25. The composite elastic band 12 accumulates excess portions of the drawcord 25 by cooperating with the drawcord 25 to form the plurality of drawcord protrusions 21 or partial loops 21 that are arranged sequentially along and protrude from the opposite sides of the composite elastic band 12. Only a few of the protrusions 21 are specifically pointed out in FIG. 4 in an effort to clarify the view. Two of the pointed out protrusions 21*a*, 21*b* are proximate to groups of individual connecting stitches 20*a*, 20*b*, 20*c*, 20*d*, as discussed in greater detail below.

In the first exemplary high stretch composite waistband 10, the elastic webs 15*a*, 15*b* preferably embody a knitted elastic construction. For example, each web 15*a*, 15*b* may include a composition of polyester and elastomeric fibers that are knitted together in a manner known to those skilled in the art. The elastomeric fibers extend in the webs 15*a*, 15*b* longitudinal direction and allow the composite elastic band 12 to be stretched lengthwise. The composite elastic band 12 may be stretchable from approximately 200 to 250% of its relaxed length (percentage being calculated by dividing the stretched length by the relaxed length, and multiplying by 100). Those skilled in the art will appreciate that although the preferred elastic webs 15*a*, 15*b* are knitted, they may also be formed using other techniques, such as weaving or braiding. Alternatively, the elastic webs 15*a*, 15*b* can be prefabricated elastic tapes. Those skilled in the art will also appreciate that the relative widths of the elastic webs 15*a*, 15*b* may be varied in order to position the drawcord 25 closer to the top or bottom of the composite elastic band 12.

The preferred connecting stitch 20 is a coarse, open, or loose zig zag stitch that attaches the elastic webs 15*a*, 15*b* to each other. The elastic webs 15*a*, 15*b* are separated by a distance that is approximately equal to the diameter of the drawcord 25 so that an elongate space is defined between a longitudinally extending edge 17*a* of the elastic web 15*a* and a longitudinally extending edge 17*b* of the elastic web 15*b*. The connecting stitch 20 comprises multiple individual stitches, which can be characterized as connecting members, that are connected between the edges 17*a*, 17*b* and extend across the elongate space defined between the edges 17*a*, 17*b*. The frequency of the connecting stitch 20 depends on the diameter of the drawcord 25. The connecting stitch 20 is loose enough to allow the drawcord 25 to move and oscillate through the openings defined between stitches of the connecting stitch 20 and form protrusions 21 (FIG. 4) when the composite elastic band 12 is allowed to contract from a stretched state. The connecting stitch 20 is also tight enough to hold the drawcord 25 in place when the composite elastic band 12 is relaxed and the drawcord 25 is not being pulled by a user.

More particularly, the longitudinally extending edge 17*a* of the elastic web 15*a* is generally parallel to and spaced apart from the longitudinally extending edge 17*b* of the elastic web 15*b*. Each of the edges 17*a*, 17*b*, examples of which are depicted in the magnified views of FIGS. 6 and 7, is preferably finished (e.g., crisscrossed, squared, or rounded) such that they will not unravel or become unknitted. The finished edges 17*a*, 17*b* are connected to each other by the connecting stitch 20 in the manner described above and below. The connecting stitch 20 is preferably a continuous piece of yarn, or similar material, that is not part of either of the elastic webs 15*a*, 15*b*. Segments of the connecting stitch 20 extend laterally between the finished edges 17*a*, 17*b* in an oscillatory fashion. The individual segments (e.g., members) of the yarn of the connecting stitch 20 that extend between the finished edges 17*a*, 17*b* are preferably spaced from one another, and are not intertwined or meshed with one another. The arrangement of the yarn of the connecting stitch 20 is preferably different from the arrangement of each of the parts of the elastic webs 15*a*, 15*b*.

The drawcord 25 is located between the finished edges 17*a*, 17*b* such that the drawcord 25 is not embedded or intermeshed in either of the elastic webs 15*a*, 15*b*. The drawcord 25 is laced back and forth through spaces or openings defined between the segments or individual stitches of the connecting stitch 20. The connecting stitch 20 is loose enough to allow the drawcord 25 to move through the openings or spaces defined between the individual stitches of the connecting stitch 20 when such movement is urged by a user of the composite waistband 10, but tight enough to hold the drawcord 25 to the composite waistband 20 when the elastic webs 15*a*, 15*b* are relaxed and the drawcord 25 is not pulled by a user.

Referring primarily to FIG. 4, when the composite elastic band 12 is stretched longitudinally and then released, the drawcord 25 automatically forms the protrusions 21 to accumulate excess portions of the drawcord 25. The drawcord 25 includes a first side 26 and a second side 27 (also see corresponding sides 26', 27' of the drawcord 25' of the second exemplary embodiment depicted in FIGS. 8 and 9). As depicted in FIG. 4, for a representative first longitudinal segment of the drawcord 25 that defines the upward extending protrusion 21*a*, the group of individual connecting stitches 20*c* contacts the second side 27 of the drawcord 25, and the connecting stitch 20 generally does not contact the first side 26 of the drawcord 25. That is, the protrusion 21*a* extends or protrudes into a space defined between the groups of individual connecting stitches 20*a*, 20*b*. For a representative second longitudinal segment of the drawcord 25 that is contiguous to the first segment of the drawcord 25 and defines the downward extending protrusions 21*b*, the group of individual connecting stitches 20*b* contacts the first side 26 of the drawcord 25, and the connecting stitch 20 generally does not contact the second side 27 of the drawcord 25. That is, the protrusion 21*b* extends or protrudes into a space that is defined between the groups of individual connecting stitches 20*c*, 20*d*. These patterns are repeated for the entire length of the composite waistband 10.

As depicted in FIG. 4, the composite elastic band 12 is relaxed. Further, the composite elastic band 12 has accumulated a length of drawcord 25 that is greater that the length of the relaxed composite elastic band 12. When the composite waistband 10 is configured as depicted in FIG. 4, the ends of the drawcord 25 can be grasped and pulled to pull accumulated portions of the drawcord 25 out of the composite waistband 10 (i.e.., to flatten the protrusions 21) so that the ends of the drawcord 25 are available to be tied into a bow.

The amount of accumulated drawcord 25 can be illustrated by considering an embodiment similar to the embodiment depicted in FIG. 4. For example, for a piece of composite waistband 10 in which the composite elastic band 12 is relaxed and has accumulated the drawcord 25 to define nine drawcord protrusions 21 on each side of the composite elastic band 12 (for a total of eighteen protrusions 21, like in FIG. 4), the length of the unstretched composite elastic band 12 is approximately 2.25 inches, and the length of a straight line between the opposite ends of the drawcord 25 is approximately 3 inches. Therefore, 0.75 inches of drawcord 25 extend beyond the ends of the composite elastic band 12. After the ends of the drawcord 25 are grasped and pulled to pull accumulated portions of the drawcord 25 out of the composite elastic band 12, the unstretched length of the drawcord 25 is approximately 5.75 inches. Therefore, a total of 5 inches of drawcord 12 is accumulated in the 2.25 inch length of the composite waistband 10.

The degree to which the protrusions 21 defined by the drawcord 25 protrude from the composite elastic band 12, and therefore the ratio of the drawcord 25 to the composite elastic band 12, may be altered during the manufacture of the composite waistband 10, as discussed in greater detail below. As depicted in FIG. 4, the protrusions 21 extend from the composite elastic band 12 to a limited degree. In accordance with the second exemplary embodiment of the present invention (FIGS. 8–10) and select alternative embodiments of the present invention, the protrusions 21' protrude further from the composite elastic band 12 than depicted in FIG. 4. For an individual protrusion 21', neither the first side 26' nor the second side 27' of the drawcord 25' substantially contacts the connecting stitch 20.

As discussed above, when the composite waistband 10 is configured as depicted in FIG. 4, the ends of the drawcord 25 can be grasped and pulled to release accumulated portions of the drawcord 25 from the composite elastic band 12. When the accumulated portions of the drawcord 25 are drawn from the composite elastic band 12, the protrusions 21 are flattened such that they are no longer defined (for example, see FIG. 10). Then, the composite elastic band 12 can be stretched longitudinally and released. The composite waistband 10 is constructed so that, upon the longitudinally stretching and releasing of the composite elastic band 12, the composite elastic band 12 contracts and cooperates with the drawcord 10 so that the drawcord 10 is accumulated by the composite elastic band 12 such that the drawcord defines the protrusions 21.

Turning now to FIGS. 2, 6, and 7, the process of manufacturing a preferred high stretch composite waistband 10 will be described. Those skilled in the art will appreciate that the manufacture of a preferred high stretch composite waistband 10 employs conventional knitting techniques associated with warp knit elastics, and adds the connecting stitch 20 and drawcord 25 during the knitting process.

FIG. 6 is a magnified view of a portion of the knitted elastic web 15*a*, which includes a plurality of elastomeric fibers or elastomers 30 that extend along the length of the elastic web 15*a*. The elastomers 30 are sandwiched between two filler yarns 35*a*, 35*b* that oscillate back and forth perpendicular to the elastomers 30. The front filler yarn 35*a* is located on the front side of the elastomers 30. The back filler yarn 35*b* is located on the back side of the elastomers 30. The elastomers 30 and filler yarns 35*a*, 35*b* are held together by a plurality of warp yarns 40. Each warp yarn 40 runs generally parallel to an elastomer 30. The warp yarns 40 hold the elastomers 30 and filler yarns 35*a*, 35*b* together by forming a crochet knitting stitch at each intersection of the elastomers 30 and filler yarns 35*a*, 35*b*. Those skilled in the art will understand that the filler yarns 35*a*, 35*b* are also referred to as picks or courses.

Knitted elastics are acceptably manufactured on flat bed crochet knitting machines, such as those manufactured by Muller of Switzerland and Comez S.P.A. of Italy. These machines come with needle beds of varying widths. It is common to have 400 or more needles in a needle bed. There is one warp yarn 40 and one elastomer 30 for each needle. Common flat bed crochet knitting machines are fourteen gauge and twenty gauge machines.

To knit a typical warp knit elastic web 15, the machine is set up by threading a select number of elastomer yarns 30 through eyelets in a bar positioned over the needle bed. The elastomers 30 correspond to, and are aligned with, the knitting needles. The correct number of elastomer yarns 30 is threaded and spaced across the needle bed in order to create the correct width for each elastic web and to leave space between the elastic webs 15*a*, 15*b*. The width of the elastic web 15*a* is determined by the number of elastomers 30 in the elastic web 15*a* and the spacing between the needles. This allows a number of webs 15 to be knitted simultaneously and makes full use of the needle bed.

The elastomer yarns 30 are fed into the needle bed from the top and extend vertically. The elastomers 30 are under tension controlled by sets of rollers. The needles are oriented horizontally. There is a warp yarn 40 for each needle that will be used in the knitting process.

The filler yarns 35*a*, 35*b* are fed through tubes that are located above the needle bed. There are two filler yarn tubes (front and rear) for each elastic web 15*a*, 15*b* that is being manufactured on the machine. These tubes oscillate back and forth from edge to edge of each elastic web 15 during the knitting process in order to deliver the filler yarns 35*a*, 35*b* that are stitched to the elastomers 30.

For each elastic web 15*a*, 15*b*, as the filler yarns 35*a*, 35*b* are placed along the front and back of the elongated elastomers 30, crochet stitches are formed with the warp yarns 40 to hold the elastic web 15 together. The elastic webs 15*a*, 15*b* are formed as they pass through the needle bed. Each crochet stitch is formed as the rear needle bed oscillates while the knitting needles move from back to front between the elongated elastomers 30. This action is synchronized to allow the knitting needles to hook and pull the warp yarn 40 to the opposite side of each elastomer. As this is happening, the warp yarn 40 slides up the shank of the needle and forms a loop. The needles then retract again and pull the warp yarn 40 back through the loop that was just formed. This process results in the formation of crochet stitches that are pulled tight and stitch the front and back filler yarns 35*a*, 35*b* to the elastomers 30. As the knitting is completed, the elastomers 30 are released from tension. Additional information regarding the knitting process is included in U.S. Pat. No. 5,452,591, entitled "Knitted Band with Integrated Drawcord and Method of Fabricating Same," the disclosure of which is incorporated herein by reference.

FIG. 7 illustrates two knitted elastic webs 15*a*, 15*b* with a connecting stitch 20 running back and forth to join them together. For each elastic web 15*a*, 15*b*, those skilled in the art will appreciate that the yarn that forms the connecting stitch 20 is held in place by the same crochet stitches that stitch the filler yarns 35*a*, 35*b* to the elastomer 30 that is located along the edge 17 of the elastic web 15.

The process of manufacturing the preferred high stretch composite waistband 10 begins by setting up a knitting machine to produce the correct number of elastic webs 15 with appropriate space between them. The elastic webs 15*a*, 15*b* that will be joined together by a connecting stitch 20 are separated from each other by a distance that is approximately equal to the diameter of the drawcord 25 that will be used.

The yarn that forms the connecting stitch 20 is fed through a tube that is positioned above the needle bed and between the two elastic webs 15*a*, 15*b*. As the elastic webs 15*a*, 15*b* are being knitted in the manner described above, this tube feeds the yarn that forms the connecting stitch 20 back and forth, from the edge 17*a* of the elastic web 15*a* to the edge 17*b* of the elastic web 15*b*. For each elastic web 15*a*, 15*b*, the warp yarn 40 that is knitting the fillers 35*a*, 35*b* to the elastomer 30 proximate to the edge 17 also knits the connecting yarn that forms the connecting stitch 20 to the elastomer 30 proximate to the edge 17.

The frequency at which the connecting yarn that forms the connecting stitch 20 is fed back and forth between the edges 17*a*, 17*b* can be varied to control the looseness of the connecting stitch 20. For example, in an alternative embodiment (not shown) the tube that supplies the connecting yarn that forms the connecting stitch 20 is controlled so that a group of connecting stitches 20 is followed by a "blank" space or opening through which the drawcord 25 (FIGS. 1 and 3–5) can protrude. During such a "blank" space, the connecting yarn that forms the connecting stitch 20 rides along the edge 17 of one of the elastic webs 15 and is knitted to an elastomer 30 at the edge 17 of that web 15. Varying the frequency and position of the connecting stitch 20 can be used to control the placement and amount of drawcord 25 that is incorporated into the band.

The high stretch composite waistband 10 of the first exemplary embodiment is manufactured by feeding a drawcord 25, which may be braided, woven, knitted, elastic or non-elastic, into a knitting machine in the same direction as the warp yarns 40. The drawcord 25 is fed from a stationary tube that is located above the needle bed and between the two webs 15*a*, 15*b*. In addition to moving between the edges 17*a*, 17*b*, the connecting yarn that forms the connecting stitch 20 periodically moves back and forth between the first side 26 (FIG. 4) and a second side 27 (FIG. 4) of the drawcord 25. As a result, groups of connecting stitches 20 may be connected to the elastic webs 15*a*, 15*b* slightly toward one side of the composite elastic band 12 or the other, in an alternating pattern. For example, as depicted in FIG. 4, the groups of connecting stitches 20*a*, 20*b* are connected to the edges 17*a*, 17*b* (FIGS. 2 and 3) proximate to the top sides of the elastic webs 15*a*, 15*b*, and the groups of connecting stitches 20*c*, 20*d* are connected to the edges 17*a*, 17*b* proximate to the bottom sides of the elastic webs 15*a*, 15*b*. This results in the drawcord 25 being laced back and forth through the connecting stitch 20 as depicted in FIGS. 3–5. The number of connecting stitches 20 between drawcord oscillations may be varied in order to adjust the ratio of the drawcord 25 to the composite elastic band 12.

As mentioned above, the yarn that forms the connecting stitch 20 is held in place by the same crochet stitches that stitch filler yarns 35*a*, 35*b* to elastomers 30, and the drawcord 25 is attached to the composite elastic band 12 by virtue of the forming of the connecting stitch 20. Therefore, the elastic webs 15*a*, 15*b*, composite elastic band 12, and composite waistband 10 are formed contemporaneously.

As the knitting process is completed, the resultant composite elastic band 12 is released from tension and contracts to return to its relaxed length. Those skilled in the art will appreciate that this causes the drawcord 25 to form multiple protrusions, such as protruding loops or partial loops, on both sides of the composite elastic band 12 as shown in FIG. 4. The amount of drawcord 25 that is included by this process can be adjusted or controlled by altering the number of connecting stitches 20 that are sewn before moving the connecting yarn that defines the connecting stitch 20 to the other side of the drawcord 25. The amount of drawcord 25 that is included by this process can also be adjusted by adjusting the tension on the drawcord 25 as the drawcord 25 is fed into the knitting machine. The drawcord 25 to elastic ratio can also be altered by limiting the size of the protrusions 21, loops or partial loops that can form on the sides of the composite elastic band 12.

After manufacture, the composite waistband 10 may be packaged as desired by the customer. For example, the composite waistband 10 may be festooned (i.e., layered back and forth in a container) or spooled. With reference to FIG. 1, the composite waistband 10 can be cut into lengths, formed into loops, and incorporated into garments, such as pants 11. An acceptable method for incorporating the composite waistband 10 into garments is disclosed in U.S. Pat. No. 5,375,266, the disclosure of which is incorporated herein by reference.

From the foregoing description, it will be appreciated that the present invention provides a high stretch composite waistband 10 that is capable of having a high ratio of drawcord 25 to composite elastic band 12. Generally, this is accomplished by allowing the drawcord 25 to oscillate or form multiple protrusions 21, such as protruding loops or partial loops. In the preferred embodiment, this is accomplished by repeatedly threading or lacing the drawcord 25 through the connecting stitch 20 that joins two elastic webs 15*a*, 15*b*, panels, or ribbons. When the composite elastic band 12 relaxes, the drawcord 25 forms protrusions 21, such as loops or partial loops, on both sides of the composite elastic band 12. The protrusions 21 extend through the spaces defined between groups of stitches of the connecting stitch 20.

Those skilled in the art will appreciate that the present invention provides an assortment of features and advantages. For example, the longer drawcord 25 makes it easier to stretch the product for placement on sewing equipment, thereby greatly reducing the repetitive stress on the operator's hands, wrists, and elbows. In the event the drawcord 25 becomes pulled or snagged prior to being sewn into a garment, the drawcord 25 can be re-set to its proper position by stretching and then releasing the composite elastic band 12. The drawcord 25 may be easily located and pulled from either side of the composite elastic band 12.

Figure 8:
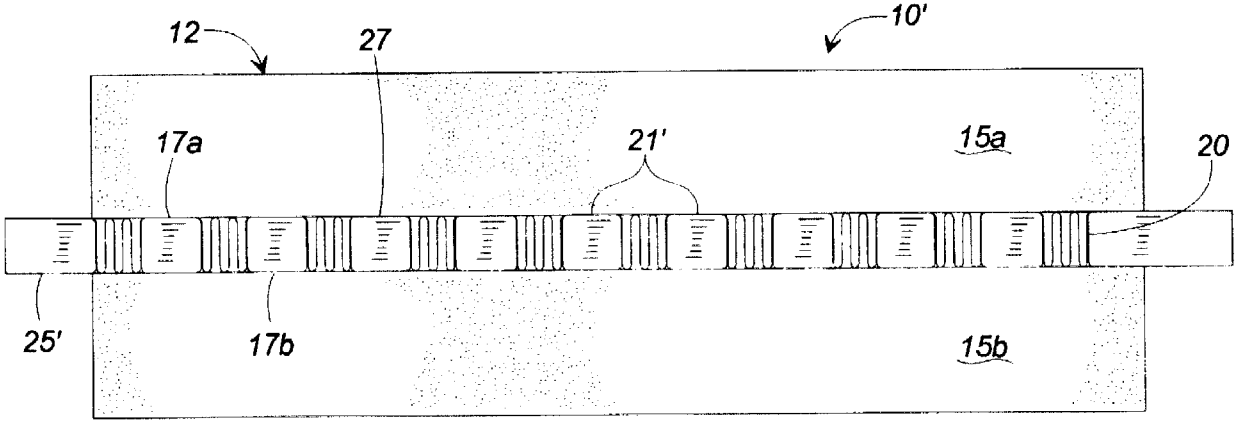
FIG. 8 is a side view of a section of the high stretch composite waistband of the second exemplary embodiment of the present invention, wherein the composite elastic band has accumulated excess portions of the drawcord.
Figure 9:
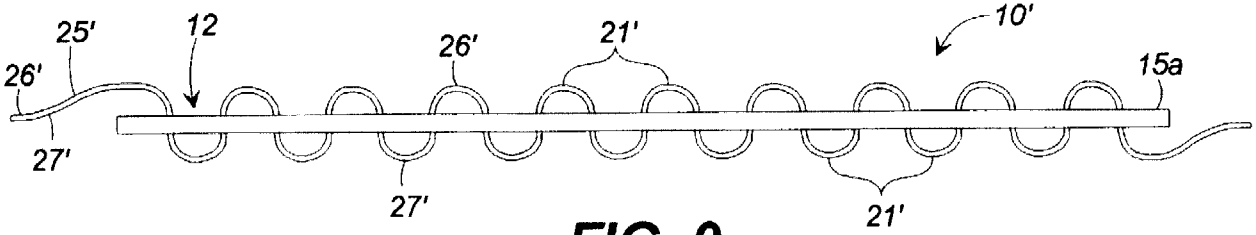
FIG. 9 is a top view of the high stretch composite waistband of FIG. 8.
Figure 10:
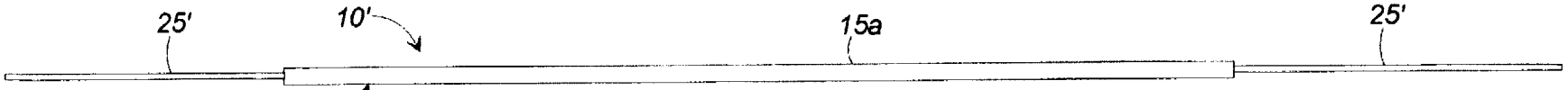
FIG. 10 is a top view of the section of the high stretch composite waistband of FIG. 8, wherein the excess portions of the drawcord have been drawn from the composite elastic band.

As an example of a variation of the present invention, FIGS. 8–10 are side and top views of a section of high stretch composite waistband 10' in accordance with a second exemplary embodiment of the present invention. Referring to FIGS. 1 and 3–5 for contrast, the drawcord 25 of the first exemplary embodiment is depicted in the form of a somewhat cylindrical cord; therefore, a cross-section of the drawcord 25 taken perpendicular to its length is somewhat circular. The composite waistband 10' of the second exemplary embodiment is generally identical to the composite waistband 10 of the first exemplary embodiment, except that the drawcord 25' of the second exemplary embodiment is flat or tape-like; therefore, a cross-section of the drawcord 25' taken perpendicular to its length is generally linear or flat. The drawcord 25' of the second exemplary embodiment is preferably a ribbon of cloth that is generally not coaxially compressible or stretchable.

In FIGS. 8 and 9, the composite elastic band 12 is relaxed and accumulating excess portions of the drawcord 25'. In FIG. 10, the composite elastic band 12 is relaxed and excess portions of the drawcord 25' have been drawn from the composite elastic band 12. The connecting stitch 20 is not seen in FIGS. 9 and 10 because the thin drawcord 25' does not have as much of a tendency as the thicker drawcord 25 (FIGS. 1 and 3–5) to push stitches of the connecting stitch 20 to the side of the composite elastic band 12.

The composite waistband 10' of the second exemplary embodiment functions generally identically to the composite waistband 10 of the first exemplary embodiment (FIGS. 1 and 3–5). When the composite waistband 10' is configured as depicted in FIGS. 8 and 9, the ends of the drawcord 25' can be grasped and pulled to release accumulated portions of the drawcord 25' from the composite elastic band 12. When the accumulated portions of the drawcord 25' are drawn from the composite elastic band 12, the protrusions 21' (only a select few of which are specifically pointed out in FIGS. 8 and 9) of the drawcord 25' are flattened such that they are no longer defined, as depicted in FIG. 10. Then, the composite elastic band 12 can be stretched longitudinally and released to cause the protrusions 21' to automatically re-form, as should be understood by those skilled in the art in light of this disclosure.

The present invention has been described in relation to particular embodiments which are intended in all respects to be illustrative rather than restrictive. Although the present invention has been described in the context of a composite waistband 10 in which the drawcord 25 is threaded through a connecting stitch 20 that joins two elastic webs **15*a*, 15*b***, those skilled in the art will understand that the principles of the present invention may be applied to other configurations. For example, the composite waistband may be constructed from a single elastic web and the drawcord may be laced back and forth through holes or openings in the elastic web that are arranged to allow the drawcord to form multiple protrusions, such as protruding loops or partial loops, on one or both sides of the elastic web as the elastic returns to a relaxed state.

Those skilled in the art will appreciate that the ratio of drawcord to elastic web may be reduced to some degree by limiting or eliminating the amount of protruding or looping that takes place on one side of the elastic web. For example, the drawcord can be movably attached proximate to the side of an elastic web, band, or the like, by attaching spaced groups of stitches to the side of the web to define a "tunnel" within which the drawcord movably resides. The spaced groups of stitches are arranged to define a series of openings to the tunnel or "blanks" along the longitudinal length of the tunnel. Portions of the drawcord can selectively protrude through those openings to accumulate and released portions of the drawcord in a manner analogous to that described above, as should be understood by those skilled in the art.

The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is defined by the appended claims.

What is claimed is:

1. A composite band, comprising:

an elongate elastic web defining a longitudinal direction; and a drawcord movably connected to the elastic web and extending generally in the longitudinal direction, wherein the drawcord defines a plurality of protrusions that protrude relative to the elastic web, and the composite band is constructed so that:

at least a section of the drawcord is capable of being pulled away from the elastic web so that protrusions of the plurality of protrusions are at least partially flattened, and the elastic web is capable of being stretched longitudinally and released so that the elastic web contracts and cooperates with the drawcord to cause the drawcord to define the plurality of protrusions.

2. The composite band of claim 1, wherein the elastic web defines a plane, and the plurality of protrusions extend generally perpendicularly relative to the plane.

3. The composite band of claim 1, wherein the plurality of protrusions define a plurality of at least partial loops.

4. The composite band of claim 1, wherein the plurality of protrusions define a longitudinally extending pattern that extends along the length of the elastic web.

5. The composite band of claim 1, wherein the composite band defines a first side and a second side, wherein the plurality of protrusions is a first plurality of protrusions that protrude from the first side of the composite band, wherein the drawcord further defines a second plurality of protrusions that protrude from the second side of the composite band, and wherein the composite band is constructed so that:

at least a section of the drawcord is capable of being pulled away from the elastic web so that protrusions of the first plurality of protrusions and the second plurality of protrusions are at least partially flattened, and the elastic web is capable of being stretched longitudinally and released so that the elastic web contracts and cooperates with the drawcord to define the first plurality of protrusions and the second plurality of protrusions.

6. The article of manufacture of claim 1, further comprising a garment having a perimeter defining an opening, wherein the composite band is formed into a loop and connected to the perimeter.

7. The composite band of claim 1, wherein the drawcord is flat.

8. The composite band of claim 1, further comprising a plurality of members movably connecting the drawcord to the elastic web, wherein protrusions of the plurality of protrusions protrude between at least some members of the plurality of members.

9. The composite band of claim 8, wherein the plurality of members comprise stitches.

10. The composite band of claim 9, wherein the drawcord comprises a first side and a second side, and a first segment and a second segment contiguous with the first segment, wherein the first side of the first segment faces a first plurality of the stitches, and at least a portion of the second side of the first segment protrudes away from and is displaced from the stitches, and wherein the second side of the second segment faces a second plurality of the stitches, and at least a portion of the first side of the second segment protrudes away from and is displaced from the stitches.

11. The composite band of claim 1, wherein the composite band defines a plurality of openings through which the plurality of protrusions protrude.

12. The composite band of claim 1, further comprising a plurality of stitches connecting the drawcord to the elastic web, wherein the plurality of stitches define the plurality of openings through which the plurality of protrusions protrude.

13. A composite band, comprising:

a longitudinally extending elastic web;

a drawcord; and a plurality of connector members movably connecting the drawcord to the elastic web so that the drawcord extends in the longitudinal direction, wherein a space is defined between neighboring connector members of the plurality of connector members so that a plurality of spaces are defined, the drawcord defining a plurality of protrusions extending at least partially through at least some spaces of the plurality of spaces.

14. The composite band of claim 13, wherein the connector members are defined by yarn.

15. The article of manufacture of claim 13, further comprising a garment having a perimeter defining an opening, wherein the composite band is formed into a loop and connected to the perimeter.

16. The composite band of claim 13, wherein the composite band is constructed so that at least a section of the drawcord is capable of being pulled away from the elastic web so that protrusions of the plurality of protrusions are at least partially flattened, and the elastic web is capable of being stretched longitudinally and released so that the elastic web contracts and cooperates with the drawcord to cause the drawcord to define the plurality of protrusions.

17. The composite band of claim 16, wherein the elastic web is a first elastic web comprising a first longitudinally extending edge, wherein the composite band further comprises a second elongate elastic web that is parallel to the first elastic web and comprises a second longitudinally extending edge, wherein the first edge is proximate to the second edge and an elongate space is defined between the first edge and the second edge, wherein the plurality of connector members comprises a plurality of stitches extending across the elongate space and connecting the first elastic web to the second elastic web, and wherein the first elastic web and the second elastic web cooperate to define a broad surface that defines a plane, and the plurality of protrusions extend generally perpendicularly relative to the plane.

18. A composite band, comprising:

an elongate first elastic web defining a longitudinal direction and comprising a first longitudinally extending edge;

an elongate second elastic web that is parallel to the first elastic web and comprises a second longitudinally extending edge, wherein the first edge is proximate to the second edge and an elongate space is defined between the first edge and the second edge;

a plurality of stitches connecting the first elastic web to the second elastic web; and a drawcord movably connected to the elastic webs by the plurality of stitches, wherein the drawcord extends generally in the longitudinal direction, wherein the drawcord is at least partially disposed in the elongate space, wherein the drawcord defines a plurality of protrusions that protrude from the elongate space between at least some of the stitches of the plurality of stitches, and wherein the composite band is constructed so that:

at least a section of the drawcord is capable of being pulled away from the elongate space so that protrusions of the plurality of protrusions are at least partially flattened, and the elastic webs are capable of being stretched longitudinally and released so that the elastic webs contract and cooperates with the drawcord to cause the drawcord to define the plurality of protrusions.

19. A method, comprising the steps of:

connecting a longitudinally extending drawcord to a longitudinally extending elastic web that is elastic in the longitudinal direction; and releasing the elastic web from longitudinal tension, wherein the drawcord is connected to the elastic web so that in response to the releasing step, the elastic web contracts and causes the drawcord to define a longitudinally extending plurality of protrusions that protrude relative to the elastic web.

20. The method of claim 19, further comprising the steps of:

pulling the drawcord away from the elastic web so that protrusions of the plurality of protrusions are at least partially flattened; and subsequent to the pulling step, stretching the elastic web longitudinally and then releasing the elastic web so that the elastic web contracts, which causes the drawcord to define the plurality of protrusions.

* * * * *